United States Patent [19]

Cutts

[11] 4,398,490

[45] Aug. 16, 1983

[54] STRUCTURAL ELEMENT, IN PARTICULAR A BOAT HULL, AND METHOD OF MAKING THE SAME

[75] Inventor: Edmund A. Cutts, Oxford, Md.

[73] Assignee: Cascut Corporation, Oxford, Md.

[21] Appl. No.: 248,851

[22] Filed: Mar. 30, 1981

[51] Int. Cl.[3] ..... B63B 5/02

[52] U.S. Cl. ..... 114/358

[58] Field of Search ..... 52/227, 422; 156/257, 156/268, 293, 303.1; 9/6 R, 6 P, 6 W; 114/65 R, 65 A, 82, 83, 84–86, 358

[56] References Cited

U.S. PATENT DOCUMENTS

| | | | |
|---|---|---|---|
| 1,913,095 | 6/1933 | Svenson . | |
| 2,397,049 | 3/1946 | Sandison . | |
| 2,554,059 | 5/1951 | Riesenecker . | |
| 2,905,579 | 9/1959 | Sumner . | |
| 3,319,387 | 5/1967 | Stewing | 52/227 |
| 4,024,620 | 5/1977 | Torcomian | 156/257 |
| 4,142,265 | 3/1979 | Pfleger | 9/6 P |

OTHER PUBLICATIONS

Page 184 of The Gougeon Brothers On Boat Construction.

*Primary Examiner*—Trygve M. Blix
*Assistant Examiner*—Thomas J. Brahan
*Attorney, Agent, or Firm*—Schuyler, Banner, Birch, McKie & Beckett

[57] ABSTRACT

A boat hull (10) and its method of construction are dislosed. The hull (10) is formed on an inner layer (12) comprised of a plurality of longitudinally extending planks (16) and an outer layer (14) comprised of a plurality of longitudinally extending planks (18). A groove (24) is formed in the outwardly facing surface of the planks (16). A cord 26 is fitted in the groove 24. An adhesive is applied into the groove (24) in such a manner that the adhesive penetrates the groove (24), passes into the interior of the cord (26) and into the pores or capillary spacing of the wood of the planks (16) in the area surrounding the groove (24). Planks (18) of the second layer (14) are attached to the outwardly facing surface of the first planks (16).

25 Claims, 7 Drawing Figures

STRUCTURAL ELEMENT, IN PARTICULAR A BOAT HULL, AND METHOD OF MAKING THE SAME

TECHNICAL FIELD

The present invention relates to a structural element formed of a plurality of wooden planks secured to one another. In particular the present invention relates to a boat hull formed of a plurality of wooden planks and a method of constructing the hull.

BACKGROUND OF THE INVENTION

In one method of constructing a boat hull, multiple layers of planking are laid diagonally at right angles to adjacent layers for purposes of obtaining transverse strength. The skin of the hull thus becomes a cross hatch of several layers of planking, with the last or outer layer being placed longitudinally in a fore and aft direction. When multiple layers are utilized, the glue weight in the layers becomes high, as does the expense of construction.

In another hull construction technique, planks are fastened to ribs or frames. The ribs or frames can be made of oak or elm, and the planks are fastened to the ribs or frames with screws and bolts. This technique has the disadvantage that a large number of plugged holes over the fasteners result, causing a reduction of planking strength, allowing electrolytic seepage and increasing the cost of production. In another hull construction technique a layer of planks are arranged longitudinally in a fore and aft direction. A rod is passed through a hole extending transversely through the planks from one side of the hull to the other. A fastener or a spring is attached to either end of the rod and provides a constraining or biasing force on either side of the rod to hold the planks together. A plurality of such rods are disposed within transverse holes located along the length of the hull. In this hull construction technique the material of the planks is not continuously fastened. Examples of this technique are illustrated in U.S. Pat. No. 1,913,095 issued on June 6, 1933 to Svenson; U.S. Pat. No. 2,554,059 issued on May 22, 1951 to Reisenecker; and U.S. Pat. No. 2,397,049 issued on Mar. 19, 1946 to Sandison.

Several hull construction techniques are illustrated in U.S. Pat. No. 2,905,579 issued on Sept. 22, 1959 to Sumner. One of the techniques utilizes the placement of metal straps around a number of planks during a gluing step to hold the planks in position until the glue, the primary fastening means, has hardened. In another technique illustrated in FIGS. 24, 25, and 26, the planking is formed of a series of wood blocks. A series of blocks are aligned longitudinally and held together by either fiberglass or wood roving received within aligned grooves of the wood blocks.

SUMMARY OF THE INVENTION

The present invention is directed to a method of constructing a structural element from a plurality of wood planks. The method includes the steps arranging a plurality of wood planks with their longitudinally extending edges abutting one another; forming at least one continuous groove in a major surface of the planks; placing a cord into the groove; applying an adhesive to the cord and planks in the area of the groove so that the adhesive penetrates into the groove, into the interior of the cord and into the pores (capillary spaces) of the wood surrounding the groove.

The method in accordance with the present invention is particularly directed to the construction of a boat hull and is comprised of the steps of: arranging a plurality of wood planks with their longitudinal edges abutting in a longitudinally extending fore to aft direction into a general shape of the hull to be constructed; forming at least one continuous groove in one major surface of the planks; placing a cord into the groove; and applying an adhesive to the cord and planks in the area of at least one groove so that the adhesive penetrates into the groove, into the interior of the cord and into the pores (capillary spaces) of the wood surrounding the groove.

The present invention is also directed to a structural element itself, in particular a boat hull.

The technique of the present invention results in a hull of sufficient transverse strength without the requirement of fastening the planks to ribs or frames. The disadvantages of fastening the planks to ribs or frames are thereby avoided. Transverse bonding occurs along the entire length of the groove and cord, rather than at a number of screw or bolt attachment points to a rib. The cords are completely embedded within the hull so that there are no outside fasteners. Complete insulation of cord from the elements is thus obtained. Because the cord is centered in the planking, lumber swelling is balanced and symmetrical rather than cantilevered as when framing is placed alongside the planking.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described several embodiments of the invention.

DETAILED DESCRIPTION OF THE INVENTION

Figure 1:
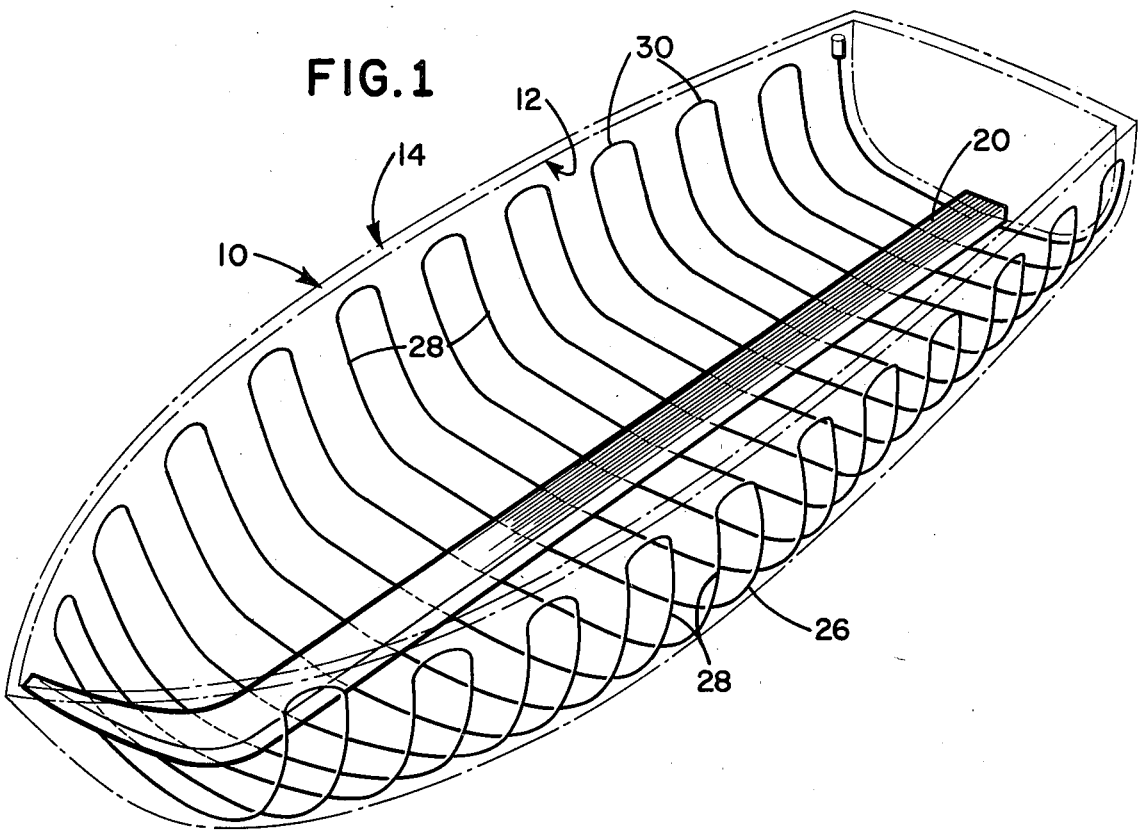
FIG. 1 is a perspective view of a boat hull in accordance with the present invention illustrating the cord inserted in the hull, with the hull shown in phantom line.

Referring to the drawings in detail, wherein like numerals indicate like elements, there is shown a FIG. 1 a boat hull constructed in accordance with the present invention designated generally as 10. The hull 10 is made up of an inner layer 12 and an outer layer 14. The inner layer 12 is comprised of a plurality of first wood planks 16. The outer layer 14 is comprised of a plurality of second wood planks 18. The planks 16 are arranged with adjacent longitudinal edges abutting one another. The planks 16 extend in a longitudinal direction, i.e. fore to aft and are shaped in a conventional manner to conform to the contour of the hull 10. The second planks 18 of the outer layer 14 are similarly arranged. A keelson 20 is attached to the inner surface of the inner layer 12 and extends fore to aft. A keel 22 extends below and is attached to the outer surface of outer layer 14. A deck 21 is shown mounted between the uppermost planks 16, 18 in FIG. 2.

Figure 2:
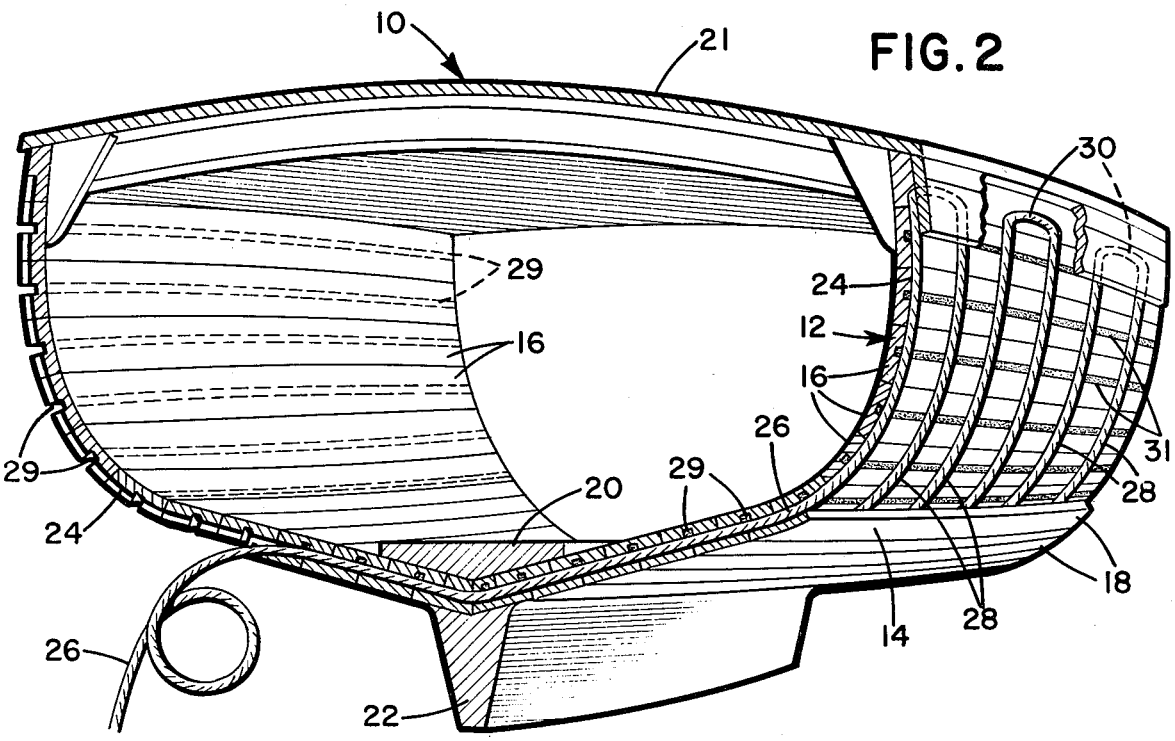
FIG. 2 is an enlarged perspective view, partially in section illustrating a partially constructed hull.

In the embodiment shown in FIGS. 1 and 2, a single continuous groove 24 is formed in the outwardly facing major surface of the first planks 16. A cord 26, preferably a single continuous cord, is fitted into the groove 24. The groove 24 and, hence, the cord 26 are arranged in a generally zigzag pattern extending back and forth across the width of the boat and along its entire length. The groove 24 thus has leg portions 28, which extend transversely, preferably perpendicular, to the longitudinal dimension of the planks 16 and loop portions 30 connecting adjacent leg portions 28 at their upper or side most direction of travel. The loop portions 30 are located in opposite uppermost planks 16. The leg portions 28 have a substantially greater length than the length of the loop portions 30. The leg portions 28 are preferably at least fifteen times the length of the loop portions 30. This assures that a large number of leg portions 28 are disposed along the length of the hull 10 to provide a sufficient amount of transverse strength by the attachment of the cord 26 to the planks 16. Preferably leg portions 28 are disposed every four to six inches along the length of the hull 10.

The cord 26 is secured within the groove 24 by the application of an adhesive. This aspect of the present invention will be described more fully hereinafter. The planks 18 are secured, preferably with an adhesive, to the outer surface of the first planks 16. Since the cord 26 is received within the groove 24, the mating surfaces of the first and second planks 16, 18 are flush with one another along their entire respective lengths.

Figure 7:
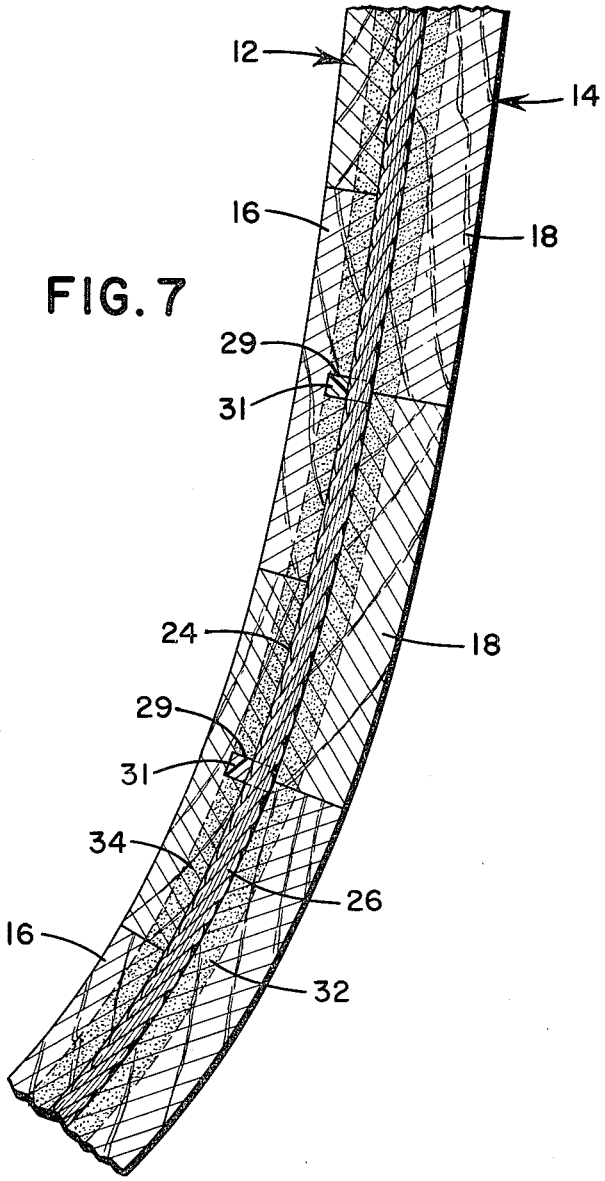
FIG. 7 is an enlarged sectional view of the boat hull shown in FIG. 2.

A plurality of longitudinally extending grooves 29 are formed in the outer surface of the planks 16 and intersect the leg portions 28 of the groove 24. Splines 31 of a foam material are preferably inserted into the grooves 29. The grooves 29 and 31 are shown in detail in FIG. 7. The splines 31 keep the glue or adhesive, which is used to secure the planks 18 to the planks 16, from filling the grooves 29. As the planks 16 swell, the grooves 29 relieve the stress that would otherwise be placed on the cords 26. The grooves 29 can be located approximately every six inches and need not be formed in every plank 16.

Figure 3:
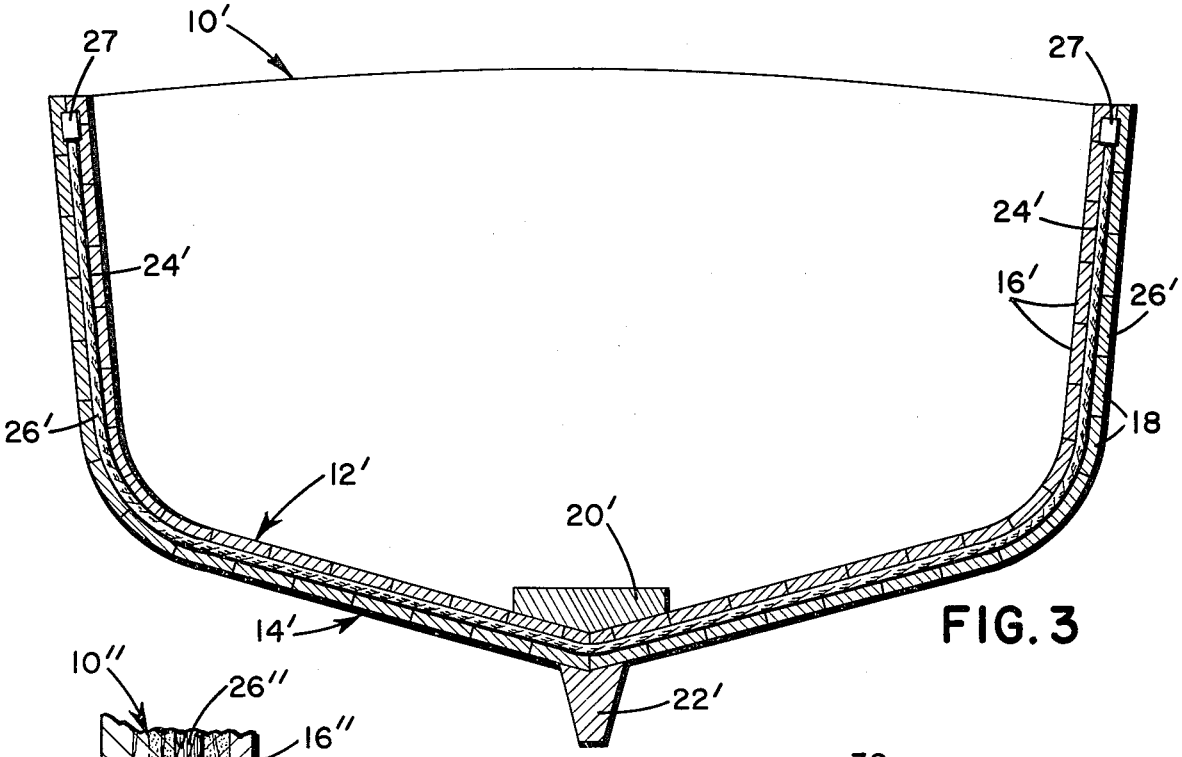
FIG. 3 is a vertical cross-sectional view of another embodiment of a hull constructed in accordance with the present invention.
Figure 6:
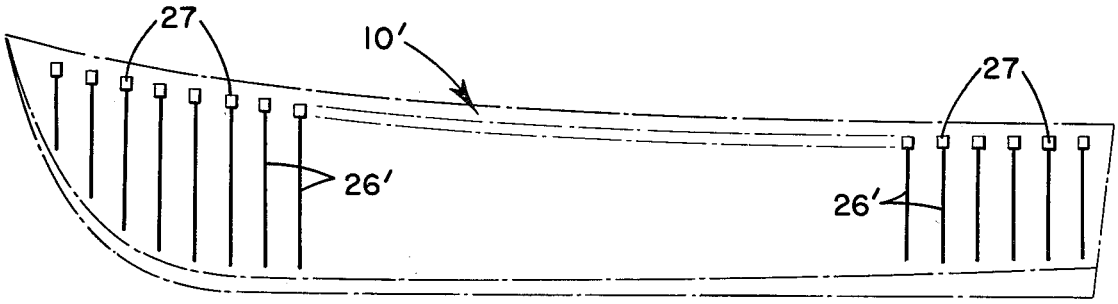
FIG. 6 is a side elevational view of the boat hull illustrated in FIG. 3.

FIGS. 3 and 6 are illustrative of a second embodiment of boat hull, designated as generally 10'. Elements of the hull 10' which are similar to elements of the hull 10 will be indicated by like primed numerals. The hull 10' is constructed similar to the hull 10 except for the manner in which the groove 24' is formed in the inner layer 12' and the type of cord 26' inserted into the groove 24'.

In the hull 10', a plurality of continuous, but separate, grooves 24' are formed in the outer surface of the first planks 16'. A separate cord 26' is received within each continuous groove 24'. Each end of the cords 26' is secured in an anchoring thimble 27 which is received within the uppermost planks 16', 18' on either side of the hull 10'. The cords 26' are disposed relatively close to one another as in the first embodiment for the purpose of providing sufficient transverse strength to the hull 10', for example every four to six inches. Also, as in the first embodiment, the cords 26' are secured within the groove 24' by the application of an adhesive in a manner described fully hereinafter.

Figure 4:
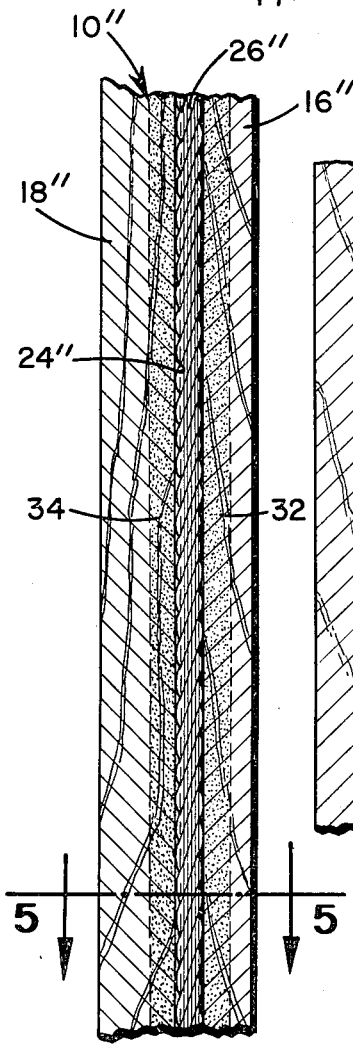
FIG. 4 is an enlarged sectional view of a portion of a structural element constructed in accordance with the present invention, illustrating the penetration of the adhesive.
Figure 5:
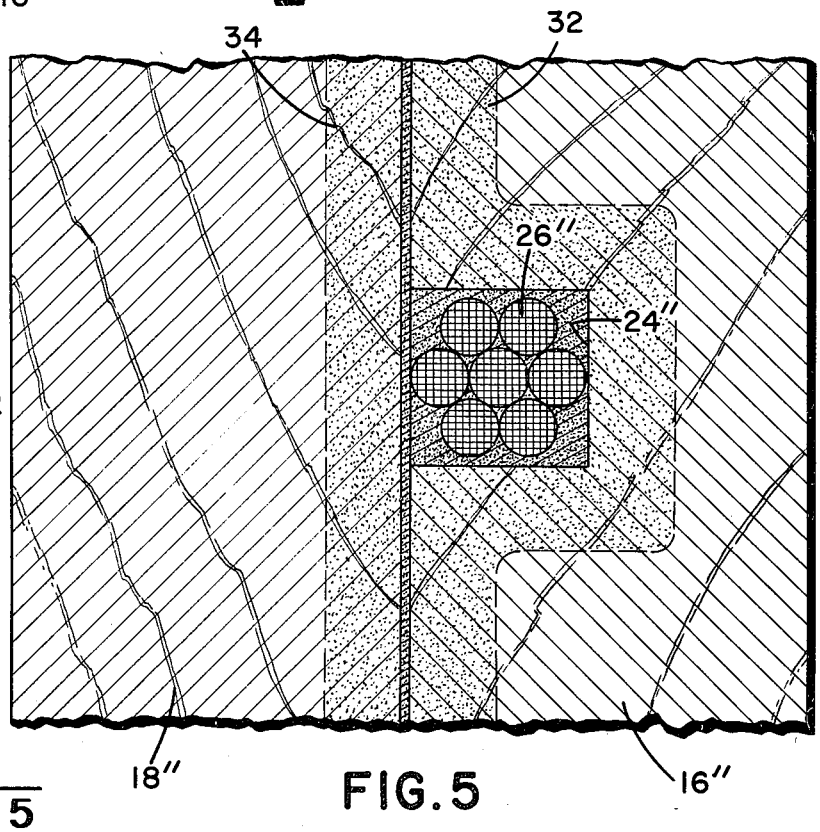
FIG. 5 is a sectional view taken generally along line 5—5 of FIG. 4 on a further enlarged scale illustrating the penetration of the adhesive.

FIGS. 4 and 5 illustrate in detail, the manner in which cords 26, 26' and 26" are adhesively bonded to the grooves 24, 24' and 24", respectively. FIGS. 4 and 5 are also illustrative of the broader concept of forming structural elements of any shape and for other purposes than boat hull construction in accordance with the present invention. FIGS. 4 and 5 should therefore be considered as illustrating planks 16" and 18" of a general structural element 10". The structural element 10" could be wall panelling, flooring, or any monocoque construction wherein one directional strength is required of the framing, for example aircraft bodies, auto bodies, etc.

The cord 26" is fitted within the groove 24" of the plank 16". The cord 26" is preferably a multi-strand metalic wire. A stainless steel 7×19 wire cable has been found especially suitable.

The adhesive is applied to the groove 24" and the plank 16" in the area of the groove. The adhesive penetrates into the groove 24" and between the strands and wires of the cord 26". The adhesive also penetrates into the pores or capillary spaces of the wood plank 16" in the area surrounding the groove 24". This adhesive penetration into the intercies of both the wire cable and capillary spaces of the wood results in an unexpectedly strong bond. When the planks 18" of the second layer are cemented or glued to the planks 16", a similar penetration of the adhesive into the capillary spaces of the plank 18" occurs. The areas of the wood that are penetrated by the adhesive are indicated by dashed lines 32, 34 and by stippling. The adhesive is preferably a conventional high tensile epoxy material which is suitable for the particular environment in which the structural element 10" is to be used. The adhesive, however, must be capable of penetrating both the spaces in the cord and the capillary spaces of the wood planks.

The present invention also relates to a method of constructing structural elements in general, and in particular, boat hulls such as hulls 10 and 10'. As a general construction technique, the present invention includes the step of arranging planks 16" so that their longitudinal edges abut one another. A continuous groove 24' is formed in one surface of the planks 16". An adhesive is then placed in the groove 24" and then a cord 26" is fitted into the groove 24". The adhesive is thus applied to the cord 26" and the planks 16" in the area of the groove 24". The adhesive then penetrates the groove 24", the spacing between the strands and wires of the cord 26" and into the pores or capillary spacing in the wood of the plank 16" in the area surrounding the groove 24". The planks 18" are thereafter cemented to the surface of the plank 16" in which the groove 24" is formed by placing an adhesive between the facing major surfaces of the planks 16", 18".

When the method in accordance with the present invention is applied to boat hull construction, the above steps are preformed with the arrangement of the planks 16 and 18 occurring on a conventional hull binding frame. The planks 16, or 16' are arranged in the shape of the hull to be constructed over the building frame so that a complete inner layer 12 or 12" is formed in an inverted position on the frame with its outer surface facing outward.

The zigzag groove 24 or the plurality of grooves 24', and the grooves 29, 29' are then formed in the outer surface of the inner layer, preferably by a routing technique. An adhesive is then applied into the groove 24 or the grooves 24' and the cord 26 or 26' is inserted or pressed into the respective grooves. A preferred technique is to apply the adhesive in a short section of the groove; insert the cord in the section where the adhesive has been applied, and continue in the same manner with short successive sections of the groove. Typically the adhesive epoxy is selected with a two hour set time so that the above technique of applying the adhesive and cord is practical. The adhesive penetrates into the spaces in the cord, for example in a 7×19 wire cable, between its wires and strands, and also penetrates into the capillary spaces in the wood planks in the area around the groove. A strong integral bond is thus formed. Finally, another layer of adhesive is applied either to the planks 16, 16' or 18, 18' and the outer layer of planks is secured to the inner layer of planks by the second layer of adhesive. Alternatively, another type of material could be used for the outer layer, for example, fiberglass sheeting. The splines 31 are inserted prior to applying the second layer of adhesive.

Numerous characteristics and advantages of the invention have been set forth in the foregoing description, with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

What is claimed is:

1. A method of constructing a wooden boat hull comprising the steps of:

(a) arranging a plurality of first wood planks with their longitudinal edges abutting in a longitudinally extending fore to aft direction in the general shape of the hull to be constructed;

(b) forming at least one continuous groove in one major surface of said planks, transversely across said planks between opposite uppermost planks;

(c) placing a cord into said at least one continuous groove;

(d) forming an integral bond between the interior of said cord and the interior of said wood planks to provide sufficient transverse strength to the hull by:

(i) placing an adhesive into said at least one continuous groove;

(ii) causing said adhesive to penetrate into the interior of said cord and the pores of said wood planks in the area surrounding said groove; and (iii) causing said adhesive to set to form said bond; and (c) attaching a second layer of second wood planks over the surface of said plurality of first wood planks in which said groove is formed to cover said cord and groove and to form a two-layered wooden hull structure.

2. A method in accordance with claim 1 wherein step (d) includes applying said adhesive into said groove prior to placing said cord into said groove.

3. A method in accordance with claim 1, or 2 wherein step (b) includes forming a single continuous groove in said planks, said groove extending in a generally zigzag pattern across said first planks between opposite sides of the hull and extending from fore to aft.

4. A method in accordance with claim 3 wherein leg portions of said pattern extend transverse to the longitudinal direction of said first planks with adjacent leg portions interconnected by loop portion extending through an uppermost one of said first planks.

5. A method in accordance with claim 4 wherein said loop portions of said pattern are substantially shorter than said leg portions of said pattern.

6. A method in accordance with claim 4 wherein the length of each leg portion of said pattern is at least fifteen times the length of each loop portion of said pattern.

7. A method in accordance with claim 4 wherein adjacent leg portions of said pattern are spaced approximately four to six inches from one another.

8. A method in accordance with claim 1 or 2 wherein said cord is comprised of multi-strand metalic wire.

9. A method in accordance with claim 8 wherein said wire is comprised of a seven by nineteen stainless steel wire.

10. A method in accordance with claim 1 or 2 wherein said adhesive is comprised of an epoxy material.

11. A method in accordance with claim 1 or 2 wherein said first plurality of planks are arranged as a complete inner layer of said hull in an inverted position on a hull construction frame, thereafter, said groove is formed in an outward facing surface of said inner layer.

12. A method in accordance with claims 1 or 2 wherein step (b) includes forming a plurality of separate, longitudinally spaced grooves extending transversely of the longitudinal direction of said first planks.

13. A method in accordance with claim 12 wherein step (c) includes placing a separate, continuous cord in each of said grooves.

14. A method in accordance with claim 12 wherein adjacent grooves are spaced from one another by approximately four to six inches.

15. A method of constructing a wooden boat hull comprising the steps of:

(a) arranging a plurality of first wood planks with their longitudinal edges abutting in a longitudinally extending fore to aft direction into the general shape of the hull to be constructed;

(b) forming a single continuous groove in the outer surface of said first planks, said groove extending in a generally zigzag pattern across said first planks between opposite uppermost first planks and from fore to aft;

(c) placing a cord into said groove;

(d) forming an integral bond between the interior of said cord and the interior of said wood planks to provide sufficient transverse strength to the hull by:

(i) placing an adhesive into said at least one continuous groove;

(ii) causing said adhesive to penetrate into the interior of said cord and the pores of said first wood planks in the area surrounding said groove; and (iii) causing said adhesive to set to form said bond; and (c) attaching a plurality of second wood planks onto said outer surface of said first wood planks whereby a two-layered wooden hull is formed.

16. A method in accordance with claim 15 wherein the zigzag pattern of said groove includes leg portions extending transverse to the longitudinal direction of said first planks and loop portions joining adjacent leg portions, said leg portions being substantially longer than said loop portions.

17. A method in accordance with claim 16 wherein each leg portion is spaced from an adjacent leg portion by a distance of approximately four to six inches.

18. A method of constructing a wooden boat hull comprising the steps of:

(a) arranging a plurality of first wood planks with their longitudinal edges abutting in a longitudinally extending fore to aft direction into the general shape of the hull to be constructed;

(b) forming a plurality of longitudinally spaced grooves in an outer surface of said first planks, each groove extending transverse to the longitudinal direction of said first planks and continuously between opposite uppermost first planks;

(c) placing a cord into each of said grooves;

(d) forming an integral bond between the interior of said cords and the interior of said first wood planks to provide sufficient transverse strength to the hull by:

(i) placing an adhesive into said grooves;

(ii) causing said adhesive to penetrate into the interior of said cords and the pores of said first wood planks in the area surrounding said grooves; and (iii) causing said adhesive to set to form said bond; and (c) attaching a plurality of second wood planks to the outer surface of said first wood planks whereby a two layered wooden hull is formed.

19. A method in accordance with claim 18 wherein each groove is spaced from an adjacent groove by a distance of approximately four to six inches.

20. A wooden boat hull comprised of an inner layer formed of plurality of first wood planks extending in the longitudinal direction of said hull and arranged one above another into the general shape of the hull, a single continuous groove formed in the outer surface of said wood planks, said groove extending in a zigzag pattern across the planks between opposite uppermost first wood planks and from fore to aft, a cord fitted into said groove and an adhesive applied to and penetrating within the groove, into the interior of the cord and within the pores of the wood surrounding said groove to thereby bond said first planks to one another, and an outer layer of second wood planks extending in substantially the same longitudinal direction as said first wood planks, said second wood planks being attached to the outer surface of said first wood planks whereby the entire structural integrity of said hull is provided by the bonding of said first plank to one another by said cord and adhesive and the attachment of said outer layer of second wood planks.

21. A boat hull in accordance with claim 20 wherein said adhesive is comprised of an epoxy material.

22. A boat hull in accordance with claim 20 wherein said zigzag pattern includes longitudinally spaced leg portions extending transversely of the longitudinal direction of said first wood planks and loop portions connecting adjacent leg portions, said leg portions being substantially longer than said loop portions.

23. A wooden boat hull comprising an inner layer formed of a plurality of first wood planks extending in a longitudinal direction of said hull and arranged in the general shape of the hull, a plurality of separate continuous grooves formed in the outer surface of said first wood planks, said grooves extending transverse to the longitudinal direction of said first wood planks and between opposite uppermost first wood planks, a cord fitted into each of said grooves, an adhesive supplied to said cord and planks such that said adhesive penetrates into said groove, into said cord and into the pores of the wood surrounding said groove whereby said first planks are secured to one another, and an outer layer of second wood planks extending in substantially the same longitudinal direction as said first wood planks, said second wood planks being attached to the outside surface of said first wood planks to form a two layered hull construction with said first wood planks whereby the entire structural integrity of said hull is provided by the securement of said first planks to one another by said core and adhesive and the attachment of said outer layer of second wood planks.

24. A boat hull in accordance with claim 23 wherein adjacent grooves are spaced from one another by a distance of approximately four to six inches.

25. A boat hull in accordance with claim 23 wherein said adhesive is comprised of an epoxy material.

* * * * *

UNITED STATES PATENT AND TRADEMARK OFFICE

CERTIFICATE OF CORRECTION

PATENT NO. : 4,398,490

DATED : August 16, 1983

INVENTOR(S) : Edmund A. Cutts

It is certified that error appears in the above--identified patent and that said Letters Patent is hereby corrected as shown below:

Column 8, line 29, claim 23, "supplied" should read --applied--.

Signed and Sealed this

*Eighteenth* Day of *October 1983*

[SEAL]

*Attest:*

GERALD J. MOSSINGHOFF

*Attesting Officer*

*Commissioner of Patents and Trademarks*